US009303852B2

(12) United States Patent
Staeubli et al.

(10) Patent No.: US 9,303,852 B2
(45) Date of Patent: Apr. 5, 2016

(54) HAND-LAMP DEVICE

(75) Inventors: Tom Staeubli, Zürich (CH); Uwe Werner, Hütten (CH); Arno Lenzi, Zürich (CH); Georgios Margaritis, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 272 days.

(21) Appl. No.: 13/808,666

(22) PCT Filed: Jun. 27, 2011

(86) PCT No.: PCT/EP2011/060682

§ 371 (c)(1), (2), (4) Date: Mar. 25, 2013

(87) PCT Pub. No.: WO2012/004144

PCT Pub. Date: Jan. 12, 2012

(65) Prior Publication Data

US 2013/0170189 A1 Jul. 4, 2013

(30) Foreign Application Priority Data

Jul. 9, 2010 (DE) ..... 10 2010 031 162

(51) Int. Cl.

| | |
|---|---|
| ***F21L 4/00*** | (2006.01) |
| ***F21V 21/14*** | (2006.01) |
| ***F21L 4/04*** | (2006.01) |
| ***F21V 33/00*** | (2006.01) |

(Continued)

(52) U.S. Cl.

CPC . *F21V 21/14* (2013.01); *F21L 4/00* (2013.01); *F21L 4/04* (2013.01); *F21V 21/145* (2013.01); *F21V 33/0084* (2013.01); *F21Y 2101/02* (2013.01); *F21Y 2105/001* (2013.01)

(58) Field of Classification Search

CPC ..... F21L 4/00; F21L 4/005; F21L 4/04; F21L 7/00; F21L 15/06; F21V 19/02; F21V 21/14; F21V 21/145; F21V 21/28; F21V 21/32; F21V 21/40; F21V 21/406; F21V 33/0084; F21Y 2105/001

USPC ..... 362/109, 119, 197, 198, 199, 203, 208

See application file for complete search history.

(56) References Cited

U.S. PATENT DOCUMENTS

| | | | | |
|---|---|---|---|---|
| 4,654,764 | A | 3/1987 | Hsiao | |
| 5,176,438 | A * | 1/1993 | Fisherman | 362/198 |

(Continued)

FOREIGN PATENT DOCUMENTS

| | | |
|---|---|---|
| EP | 1 281 486 | 2/2003 |
| EP | 1 312 855 | 5/2003 |

OTHER PUBLICATIONS

International Search Report, International Application No. PCT/EP2011/060682, dated Oct. 26, 2011.

*Primary Examiner* — Y M Lee

(74) *Attorney, Agent, or Firm* — Kenyon & Kenyon LLP

(57) ABSTRACT

A hand-lamp device having a battery-receiving area, a swiveling mechanism, a lighting device and a coupling device which is provided to contact a hand-held machine-tool battery located in the battery-receiving area, and which in at least one operating state, is situated between the lighting device and the battery-receiving area. The swiveling mechanism is situated at least partially in an immediate area of the coupling device.

17 Claims, 5 Drawing Sheets

(51) Int. Cl.
*F21Y 101/02* (2006.01)
*F21Y 105/00* (2006.01)

(56) References Cited

U.S. PATENT DOCUMENTS 5,988,828 A 11/1999 Prince et al.
6,502,949 B1 1/2003 Horiyama et al.
7,048,403 B2 5/2006 Parker et al.
7,497,584 B1 3/2009 Quittner
7,705,542 B2 * 4/2010 Hilt et al. ..... 362/205
2003/0095403 A1 5/2003 Tang
2006/0113958 A1 6/2006 Lobert et al.
2006/0215395 A1 * 9/2006 Yen ..... 362/119
2009/0290335 A1 11/2009 Levine

* cited by examiner

HAND-LAMP DEVICE

FIELD

The present invention relates to a hand-lamp device.

BACKGROUND INFORMATION

U.S. Published Patent Application No. 2006/0113958 describes a hand-lamp device having a battery-receiving area, a swiveling mechanism, a lighting device and a coupling device that is provided to contact a hand-held machine-tool battery located in the battery-receiving area and, in at least one operating state, is situated between the lighting device and the battery-receiving area.

SUMMARY

The present invention relates to a hand-lamp device having a battery-receiving area, a swiveling mechanism, a lighting device and a coupling device which is provided to contact a hand-held machine-tool battery located in the battery-receiving area, and in at least one operating state, is situated between the lighting device and the battery-receiving area.

The swiveling mechanism is disposed at least partially in an immediate area of the coupling device. A "battery-receiving area" is to be understood in particular as a space that is adjacent to the coupling device and in which, at least in a ready-to-operate state, the hand-held machine-tool battery is situated in a manner that it is contacted by the coupling device. In particular, the term "swiveling mechanism" is to be understood as a mechanism that supports at least the lighting device in a manner allowing it to move, especially relative to the coupling device, about a swivel axis. Preferably, the swiveling mechanism supports the lighting device in a manner allowing it to move by at least 90 degrees, advantageously by at least 145 degrees, about the swivel axis. A "lighting device" is to be understood especially as a device which, during operation, converts an electric power into a luminous flux for the illumination, in particular, of a working place. Preferably, the luminous flux has a power of at least 50 lumens, advantageously, at least 150 lumens. In particular, a "coupling device" is to be understood as a device which is provided to electrically contact and/or especially to mechanically secure a hand-held machine-tool battery. The term "provided" in particular is to be understood as specially designed and/or furnished. A "hand-held machine-tool battery" is to be understood especially as a storage battery provided to supply a hand-held machine tool with electrical energy. In particular, the hand-held machine-tool battery is specially protected against dust and dirt and/or is adapted to an output of the hand-held machine tool. Preferably, the hand-held machine-tool battery has a plurality of cells and/or a voltage greater than 3.6 volts, advantageously greater than 10 volts. The hand-held machine-tool battery especially advantageously has lithium cells. In particular, the hand-held machine-tool battery is provided to output a wattage greater than 25 watts, advantageously greater than 50 watts, particularly advantageously, greater than 100 watts. In particular, the hand-held machine-tool battery is provided to supply a drive motor of a hand-held machine tool with electric power. By "situated between the lighting device and the battery-receiving area" in this connection is to be understood in particular that a plane intersecting the coupling device is situated between two planes parallel to it, the one plane intersecting the battery-receiving area and running next to the lighting device, and the other plane intersecting the lighting device and running next to the battery-receiving area. Preferably, the plane intersecting the coupling means is the coupler plane of the coupling device. Particularly preferred, a vertical of the coupler plane of the coupling device intersects the battery-receiving area, the coupling device and the lighting device, especially in at least this order. At least in a ready-to-operate state, the coupling means is situated preferably between the lighting device and the battery-receiving area. In particular, a "ready-to-operate state" is to be understood as a state, especially a swivel state of the swiveling mechanism, in which a luminous flux of the lighting device is able to be concentrated at least partially, preferably for the most part, on a working surface. An "immediate area of the coupling device" is to be understood especially as an area which is set apart less that 30%, advantageously less than 10%, particularly advantageously, less than 5% of a maximum extension of the hand-lamp device, from at least one part of the coupling means. Advantageously, the immediate area is set apart less than 6 cm, advantageously less than 3 cm, especially advantageously, less than 1.5 cm from at least one part of the coupling device. Preferably, a swivel axis of the swiveling mechanism intersects the immediate area of the coupling device. In particular, all bearing surfaces of the swiveling mechanism are preferably located in the immediate area. The embodiment according to the present invention makes it possible to provide a flexible and especially compact hand-lamp device. In particular, hand-held machine-tool batteries and a charging infrastructure of the hand-held machine-tool battery are able to be used in an especially versatile and efficient manner.

In a further development, the swiveling mechanism has at least one swivel axis which is located in a coupling direction of the coupling device behind the coupling device, thereby permitting an especially compact type of construction with simplicity of design. A "coupling direction" is to be understood particularly as a direction of a movement of the hand-held machine-tool battery in relation to the coupling device, in which the coupling means contacts the hand-held machine-tool battery uncontacted beforehand. "In the coupling direction behind the coupling device" is to be understood in particular that first the coupling device and then the swivel axis are located along the coupling direction. Preferably, the swivel axis is situated in the immediate area of a coupler plane of the coupling device.

Moreover, it is proposed that the swivel axis of the swiveling mechanism be aligned generally in a direction perpendicular to the coupling direction of the coupling device, thereby permitting an advantageous adjustment possibility, accompanied by simplicity of design. In particular, the hand-lamp device may be set down on a resting surface, the hand-held machine-tool battery and/or the hand grip, and the lighting device may be concentrated on a working place. "Generally" is to be understood, in particular, as with a deviation of not more than 30 degrees, advantageously, not more than 10 degrees.

It is further proposed that the swivel axis of the swiveling mechanism be aligned essentially parallel to a coupler plane of the coupling device, which means advantageously, great flexibility and, in particular, small space requirement for a transport may be achieved. A "coupler plane" is to be understood particularly as a plane located on an average main extension of the coupling device.

In addition, the swiveling mechanism is provided to support the lighting device in a manner allowing it to move, especially relative to the coupling device, about at least two swivel axes, thereby permitting an especially flexible alignment of the lighting device even at places difficult to access, and especially at places without horizontal resting surfaces.

Preferably, the swiveling mechanism has a bearing ball, especially preferred, a gooseneck. Alternatively, the swiveling mechanism could have two swivel bearings, each having a swivel axis.

Moreover, the coupling device is intended to contact the hand-held-machine-tool battery, situated in the battery-receiving area, in a manner that the contact is disengageable without using a tool, thereby permitting a particularly operator-friendly utilization. Under the term "disengageable without using a tool" is to be understood in particular that the coupling means secures the hand-held machine-tool battery in a manner disengageable by the operator using only his hands.

In addition, the present invention relates to a system having a hand-held machine-tool battery and having a hand-lamp device, especially according to the present invention.

In accordance with the present invention, the example system includes at least one gripping surface that at least partially surrounds at least a part of the hand-held machine-tool battery, especially on a plane which is aligned perpendicularly to the coupling direction. The term "gripping surface" is to be understood especially as a surface which is designed and positioned so that, in a ready-to-operate state, an operator may safely grasp it. Advantageously, the gripping surface includes two points at which a surface alignment has an angle of more than 120 degrees relative to each other, and which are set apart less than 12 cm along a surface. Preferably, the gripping surface is slip-resistant. The term "surround" is intended to mean, in particular, that the gripping surface encircles one point of the hand-held machine-tool battery on one plane by more than 120 degrees, advantageously by more than 270 degrees. Preferably, the system has at least one supporting surface which stabilizes the system when setting the system down on a surface. It is especially preferred that the supporting surface is aligned parallel to the swivel axis. Alternatively or additionally, the system has a markedly non-circular exterior shape.

This embodiment according to the present invention makes it possible to provide a flexible and especially compact system. In particular, hand-held machine-tool batteries and a charging infrastructure of the hand-held machine-tool batteries are able to be used especially efficiently and with versatility.

In a further development, at least a part of the gripping surface is located on a surface of the hand-held machine-tool battery, thereby permitting a particularly compact form of the system. Alternatively or advantageously in addition, a part of the gripping surface could be located on a surface of the hand-lamp device.

In accordance with an example embodiment of the present invention, at least a part of the gripping surface is located on a surface of the hand-lamp device which is smaller than the part of the gripping surface located on the surface of the hand-held machine-tool battery, making it possible to conveniently retain an especially compact hand-lamp device.

In addition, the example system may include a protection device which is provided to protect the coupling device, thereby permitting an advantageously broad spectrum of practical applications. A "protection device" is to be understood in particular as a device which hinders and/or advantageously prevents at least dirt and/or water from penetrating between the coupling device and the hand-held machine-tool battery. Preferably, the protection device provides protection against explosion, particularly according to the EC Directive 94/9/EC.

BRIEF DESCRIPTION OF THE DRAWINGS

Further advantages are derived from the description below. The figures show four exemplary embodiments of the present invention. The figures and the specification contain numerous features in combination. The features may be considered individually, as well, and may be combined to form further useful combinations.

DETAILED DESCRIPTION OF EXAMPLE EMBODIMENTS

Figure 1:
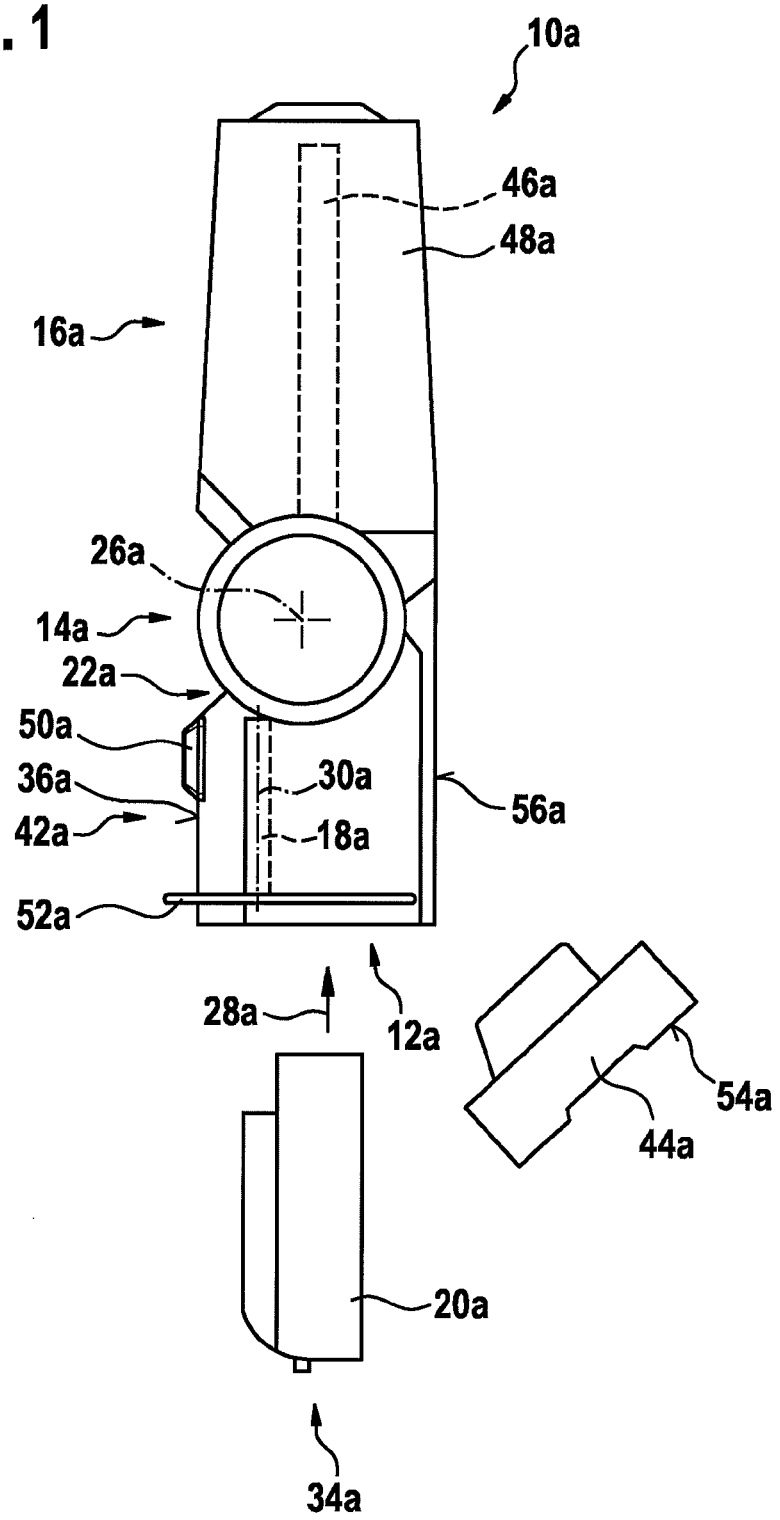
FIG. 1 shows an example system according to the present invention having a hand-held machine tool and an integratable hand-held machine-tool battery, shown removed.
Figure 2:
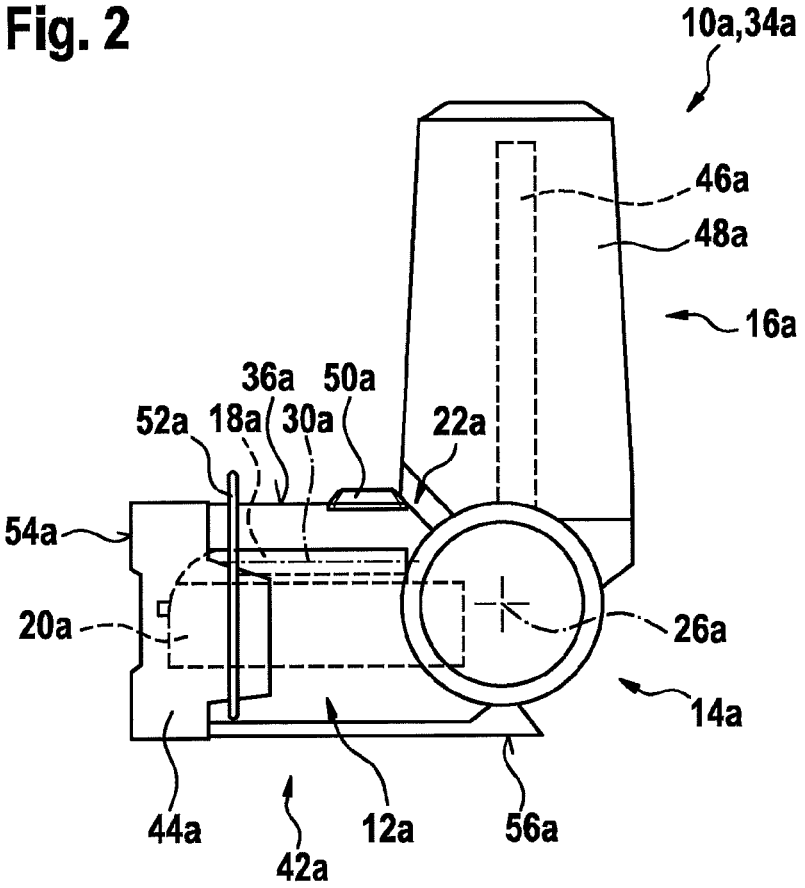
FIG. 2 shows the system from FIG. 1 having a swiveled swiveling mechanism.

FIGS. 1 and 2 show a system 34*a* having a hand-lamp device 10*a* and having a hand-held machine-tool battery 20*a*. Hand-lamp device 10*a* includes a battery-receiving area 12*a*, a swiveling mechanism 14*a*, a lighting device 16*a* and a coupling device 18*a*. Battery-receiving area 12*a* is located within a hand grip 42*a* of hand-lamp device 10*a*. Hand grip 42*a* has a battery cover 44*a* which, in a ready-to-operate state, closes an opening of battery-receiving area 12*a*.

Coupling device 18*a* has contacts and a detention arrangement, not shown in greater detail, which, in a ready-to-operate state, contact a hand-held machine-tool battery 20*a* located in battery-receiving area 12*a*. When the alignment of swiveling mechanism 14*a* is angled, coupling device 18*a* is situated between lighting device 16*a* and battery-receiving area 12*a*. To achieve contacting, hand-held machine-tool battery 20*a* is able to be pushed by an operator in a coupling direction 28*a* into hand grip 42*a*. Coupling direction 28*a* is aligned from battery cover 44*a* in the direction of swiveling mechanism 14*a*. Coupling device 18*a* contacts hand-held machine-tool battery 20*a*, located in battery-receiving area 12, in a manner allowing disengagement without using a tool.

Swiveling mechanism 14*a* supports lighting device 16*a* in a manner allowing it to swivel relative to coupling device 18*a* about a swivel axis 26*a*, and specifically, by approximately 180 degrees. Swiveling mechanism 14*a* is disposed in an immediate area 22*a* of coupling device 18*a*, and to be more precise, swivel axis 26*a* is situated approximately 4 cm away from coupling device 18*a*. A distance between a bearing surface (not further shown) of swiveling mechanism 14*a* and a contact of coupling device 18*a* is approximately 2 cm.

Swivel axis 26*a* is situated in coupling direction 28*a* of coupling means 18*a* behind coupling device 18*a*, and more precisely, between a middle swiveling position of lighting device 16*a* shown in FIG. 1, and battery-receiving area 12*a*. It is aligned perpendicularly to coupling direction 28*a* and parallel to a coupler plane 30*a* of coupling device 18*a*.

Lighting device 16*a* has an illuminant 46*a*. Illuminant 46*a* is in the form of a low-pressure gas-discharge lamp, and specifically, a fluorescent tube. Illuminant 46*a* has a main extension direction perpendicular to swivel axis 26*a*. The principal beam directions of illuminant 46*a* are oriented perpendicularly to the main extension direction. Lighting device 16*a* includes an impact-resistant illuminant housing 48*a*.

System 34*a* has a gripping surface 36*a*. Gripping surface 36*a* is located completely on hand grip 42*a* of hand-lamp device 10*a*. In a ready-to-operate state, hand-held machine-tool battery 20*a* is integrated completely into hand-lamp device 10*a*, and therefore is not able to be grasped. However, gripping surface 36*a* surrounds hand-held machine-tool battery 20*a* in the manner of a cylinder sleeve. Thus, a volume area of hand-held machine-tool battery 20*a* is used as hand grip 42*a*. An operator-control element 50*a* is located on gripping surface 36*a*.

Hand-lamp device 10*a* has a protection device (not shown more precisely). The protection device is effective between battery cover 44*a* and a remainder of hand-lamp device 10*a*. Owing to the protection device, hand-lamp device 10*a* is protected in a manner allowing it to be used in a potentially explosive atmosphere. Among other things, the protection device protects coupling device 18*a*. In addition, hand-lamp device 10*a* has electronics (not further shown). The electronics supply lighting device 16*a* with energy. The electronics have a circuit which monitors a state of charge of the hand-held machine-tool battery and signals it by light signals, and specifically, of lighting device 16*a*.

Hand-lamp device 10*a* further includes a mounting bracket 52*a*. With the aid of mounting bracket 52*a*, hand-lamp device 10*a* is able to be secured in suspended fashion and is conveniently portable. In addition, system 34*a* has two supporting surfaces 54*a*, 56*a* which provide stability when setting system 34*a* down on a surface. Supporting surfaces 54*a*, 56*a* are aligned parallel to swivel axis 26*a*. Supporting surfaces 54*a*, 56*a* are aligned perpendicularly to each other. In one operating state, system 34*a* has on one plane a nearly rectangular exterior form perpendicular to a main extension.

Figure 3:
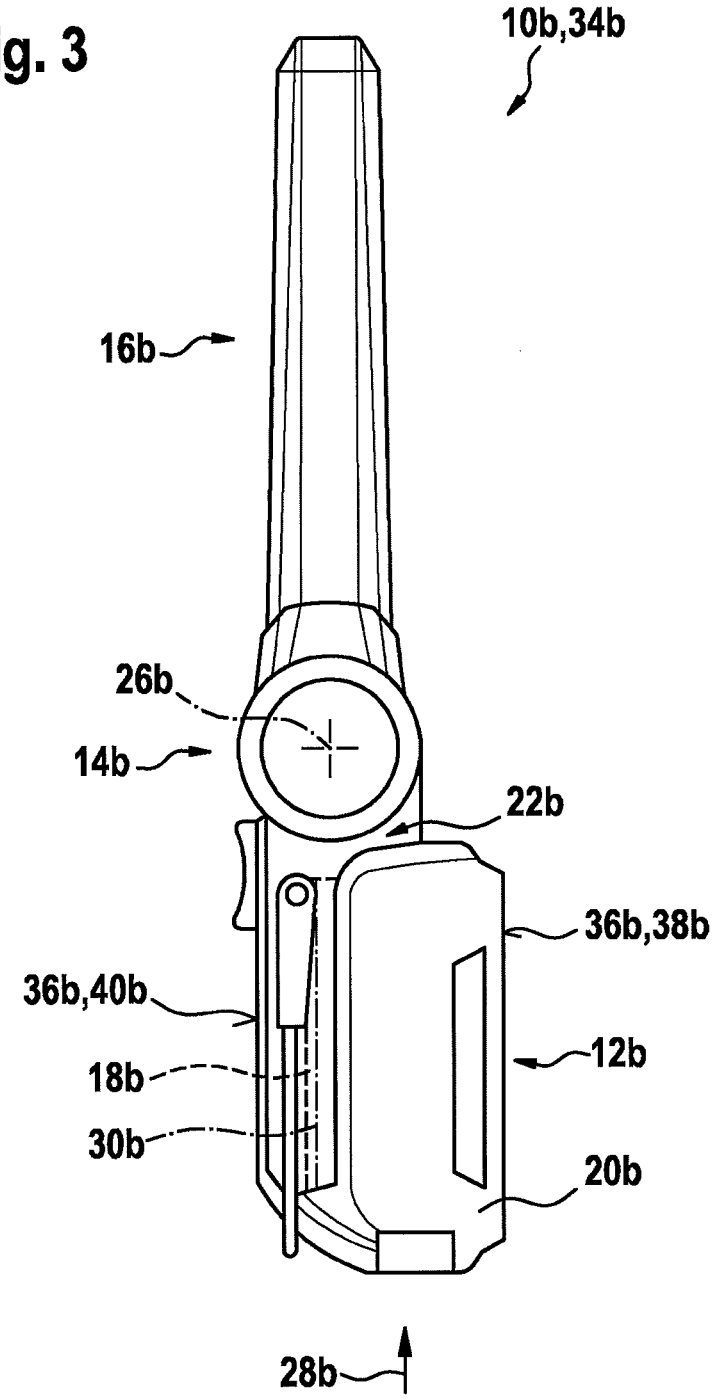
FIG. 3 shows a further exemplary embodiment of the system from FIG. 1 having an externally plugged-in hand-held machine-tool battery.
Figure 4:
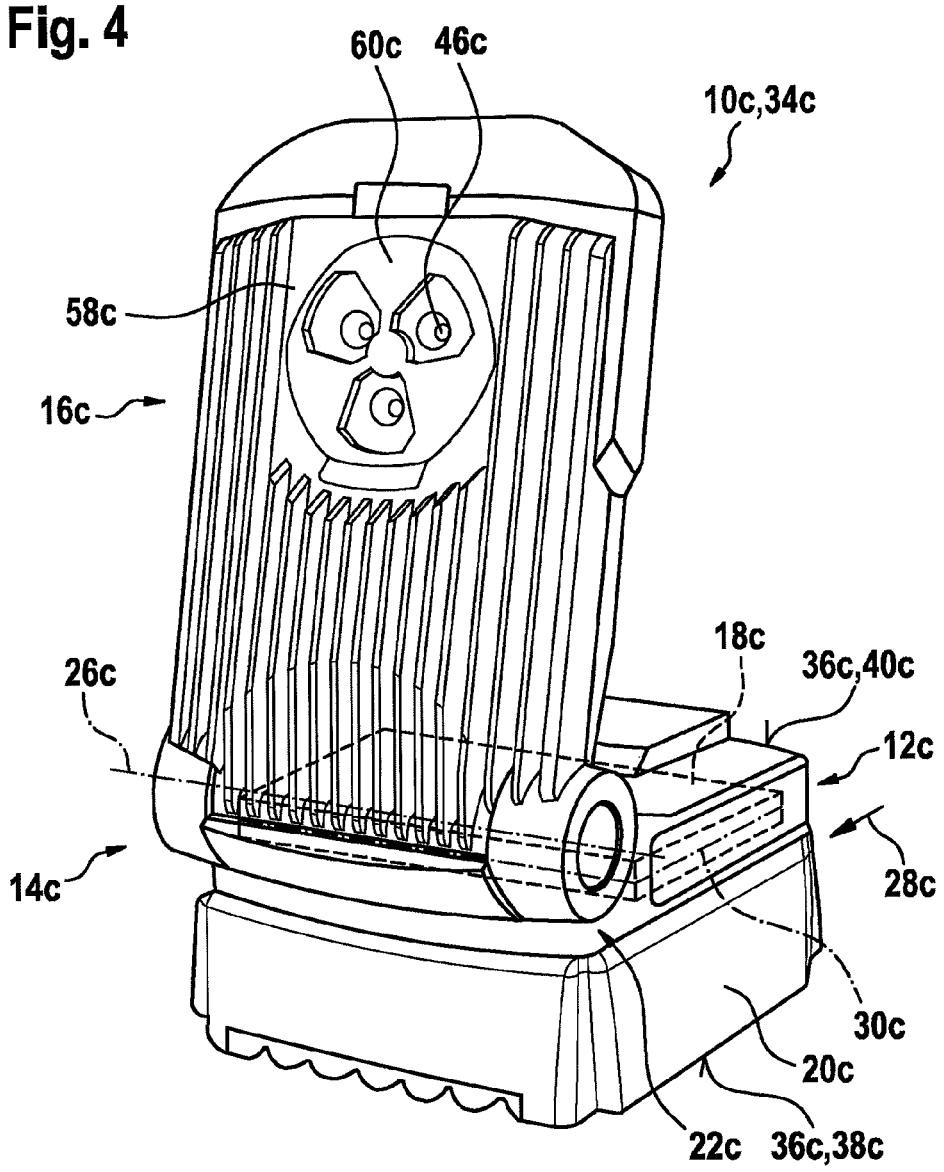
FIG. 4 shows a further exemplary embodiment of the system from FIG. 1 having a foldable lighting device.
Figure 5:
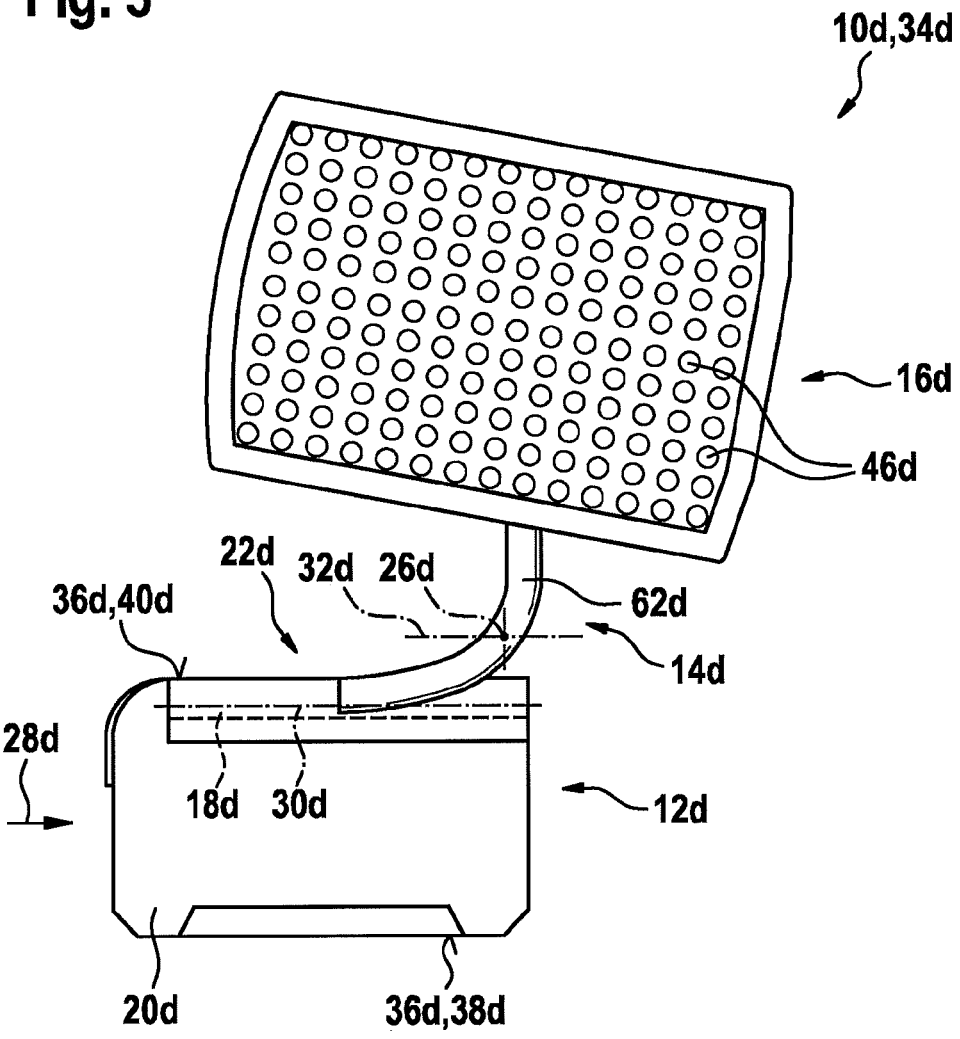
FIG. 5 shows another exemplary embodiment of the system from FIG. 1 having a lighting device able to swivel about several swivel axes.

FIGS. 3 through 5 show three further exemplary embodiments of the present invention. The following descriptions and the figures are limited generally to the differences between the exemplary embodiments; with respect to identically labeled components, especially with regard to components having the same reference numerals, in general, reference may also be made to the figures and/or the description of the other exemplary embodiments, especially of FIGS. 1 and 2. To differentiate the exemplary embodiments, the letter a is placed after the reference numerals of the exemplary embodiment in FIGS. 1 and 2. In the exemplary embodiments of FIGS. 3 through 5, the letter a is replaced by the letters b through d.

FIG. 3 shows a system 34*b* having a hand-lamp device 10*b* and a hand-held machine-tool battery 20*b*. Hand-lamp device 10*b* includes a battery-receiving area 12*b*, a swiveling mechanism 14*b*, a lighting device 16*b* and a coupling device 18*b*. Swiveling mechanism 14*b* is disposed in an immediate area 22*b* of coupling means 18*b*, and specifically, approximately 3.5 cm away. Swiveling mechanism 14*b* supports lighting device 16*b* in a manner allowing it to move by 180 degrees about a swivel axis 26*b*. Lighting device 16*b* is shown in a middle swivel position. In one operating state, coupling device 18*b* is situated between lighting device 16*b* and battery-receiving area 12*b*. Battery-receiving area 12*b* is disposed on the outside of coupling means 18*b*.

The system has a gripping surface 36*b*. A part 38*b* of gripping surface 36*b* is located on a surface of hand-held machine-tool battery 20*b*. A part 40*b* of gripping surface 36*b* is located on a surface of hand-lamp device 10*b*. Thus, gripping surface 36*b* surrounds cells of hand-held machine-tool battery 20*b* on one plane by 360 degrees. Part 40*b* of gripping surface 36*b* located on the surface of hand-lamp device 10*b* is smaller than part 38*b* of gripping surface 36*b* which is located on a surface of hand-held machine-tool battery 20*b*.

FIG. 4 shows a system 34*c* having a hand-lamp device 10*c* and a hand-held machine-tool battery 20*c*. Hand-lamp device 10*c* includes a battery-receiving area 12*c*, a swiveling mechanism 14*c*, a lighting device 16*c* and a coupling device 18*c*. Swiveling mechanism 14*c* is disposed in an immediate area 22*c* of coupling means 18*c*, and specifically, approximately 1 cm away. Swiveling mechanism 14*c* supports lighting device 16*c* in a manner allowing it to move by 180 degrees about a swivel axis 26*c*. In one operating state, coupling means 18*c* is situated between lighting device 16*c* and battery-receiving area 12*c*. A middle swivel position is aligned in a direction perpendicular to a coupling direction 28*c* of coupling means 18*c*.

Lighting device 16*c* has a cooling element 58*c* and three illuminants 46*c* in the form of light-emitting diodes. Cooling element 58*c* has an outer surface which is disposed in the beam direction of illuminants 46*c* behind an outside surface of the illuminants shown through during operation. Cooling element 58*c* is provided to cool illuminants 46*c*. In addition, cooling element 58*c* cools electronics (not further shown). In addition, lighting device 16*c* has a movably disposed diffuser 60*c*. Diffuser 60*c* is able to swivel into a luminous flux of illuminants 46*c*.

FIG. 5 shows a system 34*d* having a hand-lamp device 10*d* and a hand-held machine-tool battery 20*d*. Hand-lamp device 10*d* includes a battery-receiving area 12*d*, a swiveling mechanism 14*d*, a lighting device 16*d* and a coupling device 18*d*. Swiveling mechanism 14*d* is disposed partially in an immediate area 22*d* of coupling means 18*d*, and specifically, approximately 1 cm away. Swiveling mechanism 14*d* supports lighting device 16*d* in a manner allowing it to move about at least two swivel axes 26*d*, 32*d* marked in by way of example. To that end, swiveling mechanism 14*d* has what is termed a gooseneck 62*d*.

Lighting device 16*d* is latchable with coupling device 18*d*. In that context, a lighting direction of lighting device 16*d* points away from coupling means 18*d*. Lighting device 16*d* abuts flat against coupling means 18*d*. Lighting device 16*d* has an illuminant 46*d* in the form of a surface illuminant. It includes a plurality of light-emitting diodes.

What is claimed is:

1. A hand-lamp device, comprising:

a battery-receiving area;

a swiveling mechanism;

a lighting device; and a coupling device to contact a hand-held machine-tool battery located in the battery-receiving area, and which, in at least one operating state, is situated between the lighting device and the battery-receiving area, the swiveling mechanism being situated at least partially in an immediate area of the coupling device, wherein the swiveling mechanism includes a swivel bearing that has at least one swivel axis situated in a coupling direction of the coupling device behind the coupling device, wherein the at least one swivel axis intersects the immediate area of the coupling device, wherein the coupling device is provided to contact the hand-held machine-tool battery disposed in the battery-receiving area in a manner able to be disengaged without using a tool.

2. The hand-lamp device as recited in claim 1, wherein the swivel axis of the swiveling mechanism is aligned in a direction perpendicular to a coupling direction of the coupling device.

3. The hand-lamp device as recited in claim 1, wherein the swivel axis of the swiveling mechanism is aligned parallel to a coupler plane of the coupling device.

4. The hand-lamp device as recited in claim 1, wherein the swiveling mechanism provides support to the lighting device in a manner allowing the lighting device to move about at least two swivel axes.

5. The hand-lamp device as recited in claim 1, wherein all bearing surfaces of the swiveling mechanism are located in the immediate area.

6. The hand-lamp device as recited in claim 1, wherein the swivel axis is situated approximately 4 cm away from the coupling device.

7. The hand-lamp device as recited in claim 1, further comprising:

a battery cover configured to close an opening of the battery-receiving area.

8. A system, comprising:

a hand-held machine-tool battery; and a hand-lamp device including a battery receiving area, a swiveling mechanism, a lighting device, and a coupling device to contact a hand-held machine-tool battery located in the battery-receiving area, and which, in at least one operating state, is situated between the lighting device and the battery-receiving area, the swiveling mechanism being situated at least partially in an immediate area of the coupling device; and at least one gripping surface that at least partially surrounds at least one part of the hand-held machine-tool battery, wherein the swiveling mechanism includes a swivel bearing that has at least one swivel axis situated in a coupling direction of the coupling device behind the coupling device, wherein the at least one swivel axis intersects the immediate area of the coupling device, wherein the coupling device is provided to contact the hand-held machine-tool battery disposed in the battery-receiving area in a manner able to be disengaged without using a tool.

9. The system as recited in claim 8, wherein at least one part of the gripping surface is located on a surface of the hand-held machine-tool battery.

10. The system as recited in claim 9, wherein at least one part of the gripping surface is located on a surface of the hand-lamp device which is smaller than a part of the gripping surface which is located on the surface of the hand-held machine-tool battery.

11. The system as recited in claim 8, further comprising:

a protection device to protect the coupling device.

12. A system, comprising:

a hand-held machine-tool battery; and a hand-lamp device including:

a battery receiving area configured to receive the hand-held machine-tool battery, a swiveling mechanism having a swivel bearing that has at least one swivel axis, a lighting device, and a coupling device configured to electrically contact and mechanically secure the hand-held machine-tool battery to the hand-lamp device, and which, in at least one operating state, is situated between the lighting device and the battery-receiving area, the swiveling mechanism being situated at least partially in an immediate area of the coupling device;

wherein the swivel axis of the swivel bearing is situated perpendicular to a coupling axis of the coupling device and adjacent to a coupling plane of the coupling device along the coupling axis, wherein the swivel axis is situated vertically offset with respect to the coupling plane towards the battery-receiving area.

13. The system as recited in claim 12, wherein the coupling device is provided to contact the hand-held machine-tool battery disposed in the battery-receiving area in a manner able to be disengaged without using a tool.

14. The system as recited in claim 12, wherein the lighting device is foldable towards the coupling device.

15. The system as recited in claim 12, further comprising:

a battery cover configured to close an opening of the battery-receiving area.

16. A system, comprising:

a hand-held machine-tool battery; and a hand-lamp device including:

a battery receiving area configured to receive the hand-held machine-tool battery, a swiveling mechanism having a swivel bearing that has at least one swivel axis a lighting device, and a coupling device configured to electrically contact and mechanically secure the hand-held machine-tool battery to the hand-lamp device, and which, in at least one operating state, is situated between the lighting device and the battery-receiving area, the swiveling mechanism being situated at least partially in an immediate area of the coupling device;

wherein the swivel axis of the swivel bearing is situated perpendicular to a coupling axis of the coupling device and adjacent to a coupling plane of the coupling device along the coupling axis, wherein the swivel axis is situated substantially in line with respect to the coupling plane.

17. A system, comprising:

a hand-held machine-tool battery; and a hand-lamp device including:

a battery receiving area configured to receive the hand-held machine-tool battery, a swiveling mechanism having a swivel bearing that has at least one swivel axis, a lighting device, and a coupling device configured to electrically contact and mechanically secure the hand-held machine-tool battery to the hand-lamp device, and which, in at least one operating state, is situated between the lighting device and the battery-receiving area, the swiveling mechanism being situated at least partially in an immediate area of the coupling device;

wherein the swivel axis of the swivel bearing is situated perpendicular to a coupling axis of the coupling device and adjacent to a coupling plane of the coupling device along the coupling axis, wherein the swivel axis is situated vertically offset with respect to the coupling plane away from the battery-receiving area, wherein the coupling device is provided to contact the hand-held machine-tool battery disposed in the battery-receiving area in a manner able to be disengaged without using a tool.

* * * * *